US011200829B2

(12) United States Patent
Seder et al.

(10) Patent No.: US 11,200,829 B2
(45) Date of Patent: Dec. 14, 2021

(54) GRAYSCALE AND DIMMING CONTROL SYSTEMS AND METHODS USING VARIABLE GAMMA

(71) Applicant: GM GLOBAL TECHNOLOGY OPERATIONS LLC, Detroit, MI (US)

(72) Inventors: Thomas A. Seder, Fraser, MI (US); James A. Carpenter, Rochester Hills, MI (US); Sungwook Cho, Shelby Township, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 188 days.

(21) Appl. No.: 16/733,952

(22) Filed: Jan. 3, 2020

(65) Prior Publication Data

US 2021/0209992 A1 Jul. 8, 2021

(51) Int. Cl.

| | |
|---|---|
| ***G09G 3/20*** | (2006.01) |
| ***G09G 3/32*** | (2016.01) |
| ***G09G 3/3208*** | (2016.01) |

(52) U.S. Cl.

CPC ..... *G09G 3/2007* (2013.01); *G09G 3/32* (2013.01); *G09G 3/3208* (2013.01); *G09G 2320/0233* (2013.01); *G09G 2320/0276* (2013.01); *G09G 2320/0673* (2013.01); *G09G 2320/0693* (2013.01); *G09G 2330/02* (2013.01); *G09G 2380/10* (2013.01)

(58) Field of Classification Search

None

See application file for complete search history.

(56) References Cited

U.S. PATENT DOCUMENTS

| | | | | |
|---|---|---|---|---|
| 2015/0194105 | A1* | 7/2015 | Han | G09G 3/3648 345/690 |
| 2015/0206485 | A1* | 7/2015 | Kim | G09G 3/3607 345/690 |
| 2016/0042687 | A1* | 2/2016 | Jeong | G09G 3/3233 345/690 |
| 2018/0040295 | A1* | 2/2018 | Deng | G09G 5/10 |

* cited by examiner

*Primary Examiner* — Krishna P Neupane

(74) *Attorney, Agent, or Firm* — Harness, Dickey & Pierce, P.L.C.

(57) ABSTRACT

A display control system includes: a display including a plurality of pixels; a lookup table including grayscale values and magnitudes of power corresponding to the grayscale values, respectively, where first ones of the grayscale values that are less than a predetermined grayscale value are calibrated based on the display achieving a gamma of greater than 2.2 and second ones of the grayscale values that are greater than the predetermined grayscale value are calibrated based on the display achieving a gamma of 2.2; a driver module configured to: based on a grayscale pixel map including a grayscale value for each pixel of the display, determine magnitudes of power to apply to pixels, respectively, using the lookup table; and apply power to the pixels of the display according to the determined magnitudes of power, respectively.

20 Claims, 7 Drawing Sheets

604 608

| GS | Gamma |
|---|---|
| 39 | 2.2179 |
| 38 | 2.2196 |
| 37 | 2.2215 |
| 36 | 2.2235 |
| 35 | 2.2257 |
| 34 | 2.2281 |
| 33 | 2.2308 |
| 32 | 2.2337 |
| 31 | 2.2369 |
| 30 | 2.2403 |
| 29 | 2.2441 |
| 28 | 2.2483 |
| 27 | 2.2528 |
| 26 | 2.2578 |
| 25 | 2.2632 |
| 24 | 2.2692 |
| 23 | 2.2757 |
| 22 | 2.2828 |
| 21 | 2.2906 |
| 20 | 2.2992 |
| 19 | 2.3085 |
| 18 | 2.3187 |
| 17 | 2.3299 |
| 16 | 2.3422 |
| 15 | 2.3555 |
| 14 | 2.3702 |
| 13 | 2.3862 |
| 12 | 2.4038 |
| 11 | 2.4229 |
| 10 | 2.4439 |
| 9 | 2.4669 |
| 8 | 2.4921 |
| 7 | 2.5196 |
| 6 | 2.5496 |
| 5 | 2.5826 |
| 4 | 2.6186 |
| 3 | 2.6580 |
| 2 | 2.7012 |
| 1 | 2.7484 |
| 0 | 2.8000 |

FIG. 6

GRAYSCALE AND DIMMING CONTROL SYSTEMS AND METHODS USING VARIABLE GAMMA

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates to digital displays and more particularly to display control and calibration systems and methods.

A flat-panel display (FPD) is an electronic viewing technology that enables users to see content in a range of entertainment, consumer electronics, personal computer, and mobile devices, and many types of medical, transportation and industrial equipment. Examples of content include still images, moving images, text, and other visual content.

FPDs are lighter and thinner than traditional cathode ray tube (CRT) displays (e.g., of televisions). FPDs may be less than 10 centimeters (3.9 in) thick. There are two different categories of FPDs: volatile and static. Volatile FPDs (e.g., (e.g., liquid-crystal displays (LCDs)) require that pixels be periodically electronically refreshed to retain their state. A volatile display only shows an image when it has power applied power. Static FPDs include materials whose color states are bistable and can retain the text or images on the screen even when the power is off.

SUMMARY

In a feature, a display control system includes: a display including a plurality of pixels; a lookup table including grayscale values and magnitudes of power corresponding to the grayscale values, respectively, where first ones of the grayscale values that are less than a predetermined grayscale value are calibrated based on the display achieving a gamma of greater than 2.2 and second ones of the grayscale values that are greater than the predetermined grayscale value are calibrated based on the display achieving a gamma of 2.2; a driver module configured to: based on a grayscale pixel map including a grayscale value for each pixel of the display, determine magnitudes of power to apply to pixels, respectively, using the lookup table; and apply power to the pixels of the display according to the determined magnitudes of power, respectively.

In further features, the driver module is configured to apply power to the pixels of the display from a battery of a vehicle.

In further features: an image source is configured to generate an image for display on the display; and a grayscale module is configured to generate the grayscale pixel map based on the image.

In further features, the image source includes a camera of a vehicle.

In further features, the image is not gamma corrected.

In further features, the display is an organic light emitting diode (OLED) display.

In further features, the display is a micro light emitting diode (LED) display.

In further features, the first ones of the grayscale values of the lookup table decrease from achieving a first predetermined gamma value that is greater than 2.2 decrease toward achieving a gamma of 2.2 as the first ones of the grayscale values approach the predetermined grayscale value.

In further features, the first predetermined gamma value is greater than or equal to 2.5.

In further features, the first predetermined gamma value is greater than or equal to 2.7.

In further features, the first predetermined gamma value is approximately equal to 2.8.

In further features, the lookup table is calibrated such that the decrease from achieving the first predetermined gamma value that is greater than 2.2 to the gamma of 2.2 occurs such that each change in luminance between two adjacent ones of the first ones of the grayscale values is less than a predetermined luminance change.

In further features, the lookup table is calibrated such that the decrease from achieving the first predetermined gamma value that is greater than 2.2 to the gamma of 2.2 follows an exponential decay function.

In further features, the lookup table is calibrated such that the decrease from achieving the first predetermined gamma value that is greater than 2.2 to the gamma of 2.2 follows a natural log decay function.

In further features, the lookup table is calibrated such that the decrease from achieving the first predetermined gamma value that is greater than 2.2 to the gamma of 2.2 follows a power 10 log decay function.

In further features: the display is configured to achieve 256 different grayscale values; and the lookup table includes less than 256 grayscale values.

In a feature, a display control method includes: based on a grayscale pixel map including a grayscale value for each pixel of a display, determining magnitudes of power to apply to the pixels, respectively, using a lookup table, where the lookup table includes grayscale values and magnitudes of power corresponding to the grayscale values, respectively, and where first ones of the grayscale values that are less than a predetermined grayscale value are calibrated based on the display achieving a gamma of greater than 2.2 and second ones of the grayscale values that are greater than the predetermined grayscale value are calibrated based on the display achieving a gamma of 2.2; and applying power to the pixels of the display according to the determined magnitudes of power, respectively.

In further features, applying power to the pixels of the display includes applying power to the pixels of the display from a battery of a vehicle.

In further features, the display control method further includes: generating an image for display on the display; and generating the grayscale pixel map based on the image.

In further features, the lookup table is calibrated such that the decrease from achieving the first predetermined gamma value that is greater than 2.2 to the gamma of 2.2 occurs such that each change in luminance between two adjacent ones of the first ones of the grayscale values is less than a predetermined luminance change.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein:

FIG. 6 includes a portion of an example grayscale to gamma table; and

In the drawings, reference numbers may be reused to identify similar and/or identical elements.

DETAILED DESCRIPTION

Digital displays, such as organic light emitting diode (OLED) and micro light emitting diode (LED) displays, may be calibrated to achieve a fixed gamma value of 2.2 or approximately 2.2 across all possible grayscale values. In such a case, however, banding may be visible on the display due to changes in luminosity from one grayscale value to the next being perceivable by the human eye.

The present application involves calibrating a display to achieve gamma values higher than 2.2 at low grayscale values (e.g., less than a predetermined grayscale value). For example, a display may be calibrated to decrease from a predetermined gamma value (e.g., 2.8) at a lowest grayscale value ($GS_0$) to a gamma value of 2.2 as the GS values increase toward the predetermined grayscale value. The variable gamma at low grayscale values may prevent or minimize banding by causing luminosity changes from one grayscale value to the next to be less than that perceivable by the human eye.

Figure 1:
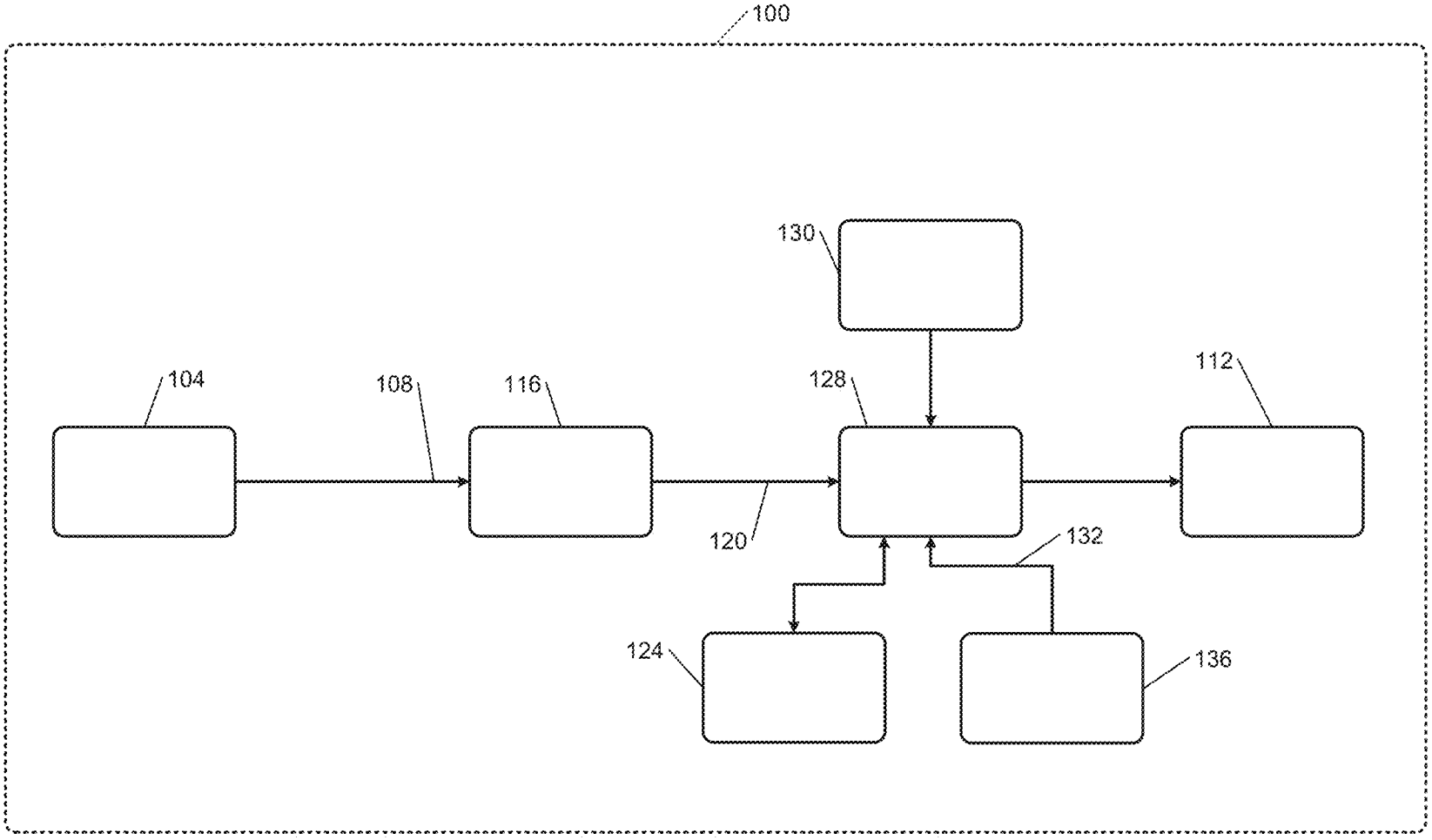
FIG. 1 is a functional block diagram of an example display control system.

FIG. 1 is a functional block diagram of an example display control system. While the example of a vehicle 100 is provided, the present application is also applicable to non-vehicle displays. An image source 104 provides an image 108 to be displayed on a display 112. The display 112 is a light emitting diode (LED) display, such as an organic LED (OLED) display, a micro LED display, or another suitable type of display. The image source 104 may include, for example, one or more cameras or another suitable image generator. The image source 104 may update the image 108 at a predetermined frequency (e.g., 60 Hertz). The display 112 may be, for example, implemented on a console of the vehicle 100, an instrument panel of the vehicle 100, or in another suitable location.

The display 112 includes a plurality of pixels. Based on the image 108, a grayscale module 116 generates a grayscale pixel map 120 corresponding to the image 108. The image 108 is not gamma corrected (i.e., gamma correction is not applied to the image 108). The grayscale pixel map 120 includes a grayscale (GS) value for each pixel of the display 112 to display the image 108 on the display 112. The GS values may range from 0 (corresponding to black) to 255 (corresponding to brightest white) for an 8 bit system. While the example of an 8 bit system is described, the present application is also applicable to other numbers of bits.

Luminance of a pixel is related to grayscale corresponding to the luminance. For example, the following equation relates luminance (L) of a pixel to grayscale (GS) of the pixel $$L_n=a(GS_n)^{\gamma}+L_0,$$

where Ln is the luminance of grayscale n ($GS_n$), a is a predetermined constant value, L0 is the luminance of grayscale 0, and γ is the gamma value.

A driver module 128 applies power from a power source 130 to the pixels of the display 112 based on the grayscale pixel map 120. For example, the driver module 128 determines a magnitude of power (e.g., current, voltage, or power) to apply to a pixel based on the GS (from the grayscale pixel map 120) for that pixel and applies the determined amount of power to that pixel. The driver module 128 does this for each pixel of the display 112. The image 108 is therefore displayed on the display 112 as the result of the application of power to the pixels according to the grayscale pixel map 120.

The driver module 128 determines the magnitude of power to apply to a pixel based on the GS of that pixel using a lookup table 124. The lookup table relates GS values to magnitudes of power to apply to achieve the GS values, respectively. An example portion of a lookup table relating GS values to powers is provided below.

| | |
|---|---|
| GS 0 | P0 |
| GS 1 | P1 |
| GS 2 | P2 |
| . . . | . . . |
| GS N − 1 | P N − 1 |
| GS N | P N |

In the table above, N is an integer greater than 2. N may be 255, as described above. P is indicative of the magnitude of power to apply to a pixel to achieve the associated GS value. For example, P 1 is the magnitude of power to apply to a pixel to achieve GS 1.

In various implementations, the lookup table 124 may include less than all of the possible GS values. For example, in the example of 256 possible GS values (an 8 bit system), the lookup table 124 may include 19 GS values and the associated (calibrated) magnitudes of power for those GS values. The included entries of the lookup table 124 may be referred to as control points. For GS values between GS values in the lookup table 124 (control points), the driver module 128 may determine the magnitude of power to achieve using interpolation, such as linear interpolation.

For $GS_0$ to a predetermined GS value (e.g., 39, 40, or 41), the lookup table 124 is calibrated to achieve different gamma (γ) values. For example, the lookup table 124 may be calibrated to achieve gamma values that decrease from a first predetermined gamma value (e.g., 2.8 or another suitable value) to a second predetermined gamma value (e.g., 2.2 or another suitable value) as the GS increases to the predetermined GS value. For the predetermined GS value to a last GS value (e.g., $GS_{255}$), the lookup table 124 is calibrated to achieve the second predetermined gamma value (e.g., 2.2 or another suitable value) for each GS value. The variable gamma values makes incremental changes in GS at low GS levels less perceptible by the human eye. Human eyes have a non-linear response to luminance and become logarithmically less sensitive as luminance increases. The variable gamma values prevents or minimizes shaded object banding on the display 112 at low GS values.

The driver module 128 may determine the magnitude of power to apply to a pixel further based on a brightness 132 set using a brightness input device 136. The brightness input device 136 may set the brightness 132 to one of a set of predetermined brightnesses (e.g., 25%, 50%, 75%, or 100% of a max brightness) based on user input to the brightness input device 136. The brightness input device 136 may include, for example, one or more buttons, knobs, and/or switches that are actuatable by a user. For example, the brightness input device 136 may decrease the brightness 132 in response to user rotation of a knob counter clockwise and increase the brightness 132 in response to user rotation of the knob clockwise.

The power source 130 may include, for example, a vehicle battery (e.g., a 12 Volt direct current battery) or another suitable power source. In the example of another type of display, the power source 130 may include an alternating current (AC) to direct current (DC) converter that converts incoming AC (e.g., from a utility) into DC.

Figure 2:
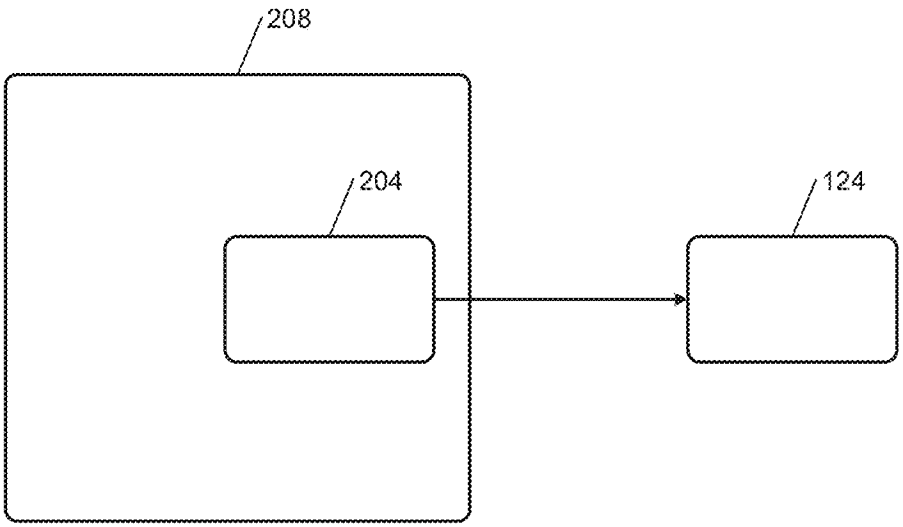
FIG. 2 is a functional block diagram of an example calibration system.

FIG. 2 is a functional block diagram of an example calibration system. A calibration module 204 populates the entries of the lookup table 124 for the display 112 to achieve the variable gamma values, as described above. The calibration module 204 may be implemented within a calibration computer 208 that is separate from the vehicle 100 and other vehicles. The calibration module 204 stores the lookup table 124 in memory. Once populated, the lookup table 124 can be stored in vehicles, such as the vehicle 100, for use in displaying images on their displays. Details regarding the calibration are provided below.

Figure 3:
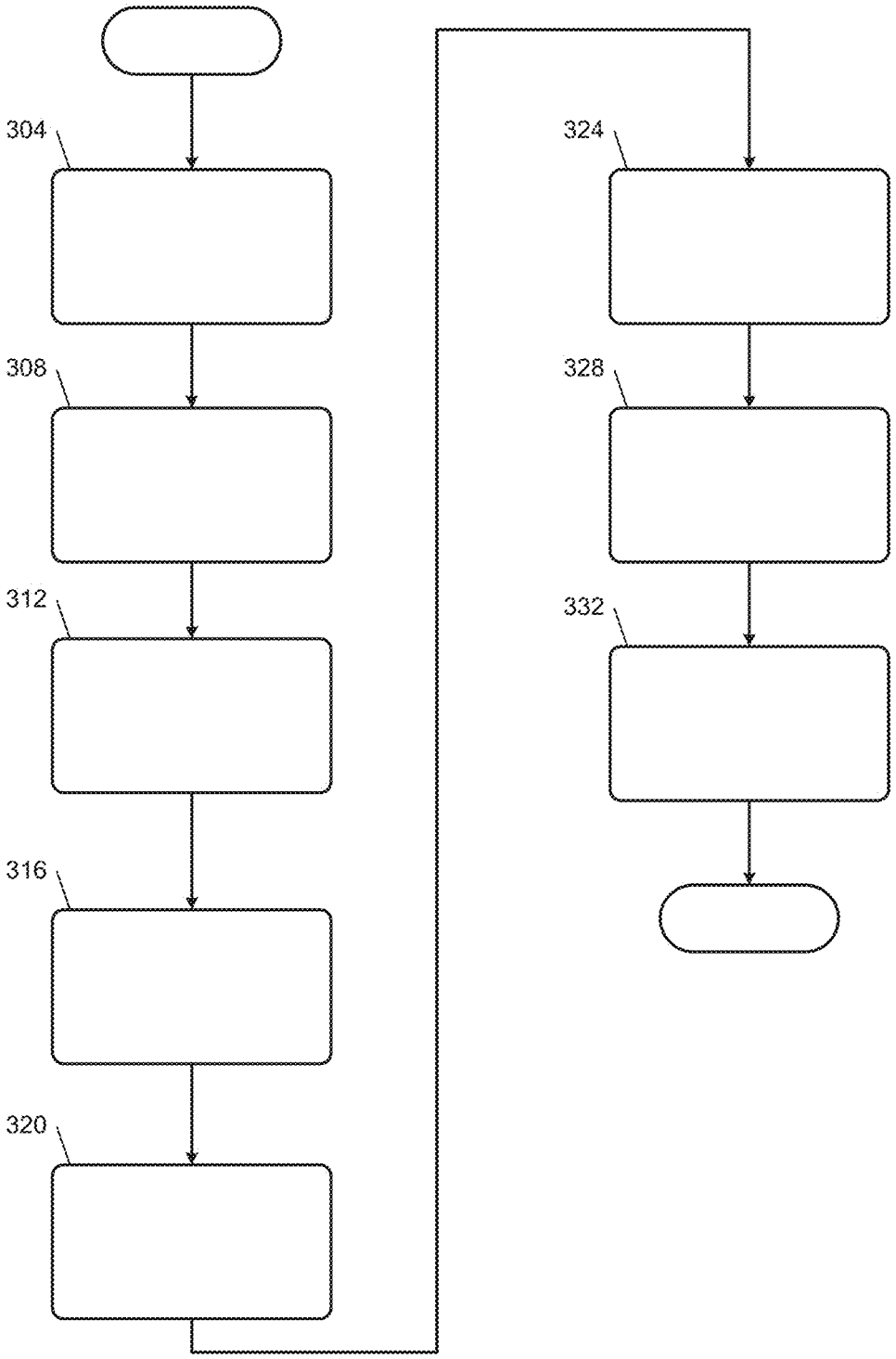
FIGS. 3 and 4 include flowcharts depicting example calibration methods.

FIG. 3 is a flowchart depicting an example method of calibrating the lookup table 124 without a complete set of measurements. Control begins with 304 where the calibration module 204 generates a GS model (by modeling GS values) from efficiency-current curves for the material of the display 112 and the pixel size of the display 112. The efficiency-current curves may be stored in memory.

At 308, the calibration module 204 obtains (reliable) measurements of luminance (L) at the locations (x, y) of pixels of the display 112. The measurements may be obtained, for example, using a photometer and/or a spectroradiometer. The calibration module 204 calibrates (e.g., GS values of) the GS model using the obtained measurements of L at the locations of the pixels.

At 312, the calibration module 204 extrapolates GS values for unmeasured luminances at the locations (x, y) of pixels, respectively, of the display 112. The unmeasured luminances may be less than a predetermined minimum measurement value of the measurement device (e.g., the photometer and/or spectroradiometer).

At 316, the calibration module 204 set the control points for the lookup table 124 using the calibrated GS model to obtain targeted luminance values at locations of pixels, respectively. The targeted luminance values may be predetermined values stored in memory of the calibration computer 208.

Figure 5:
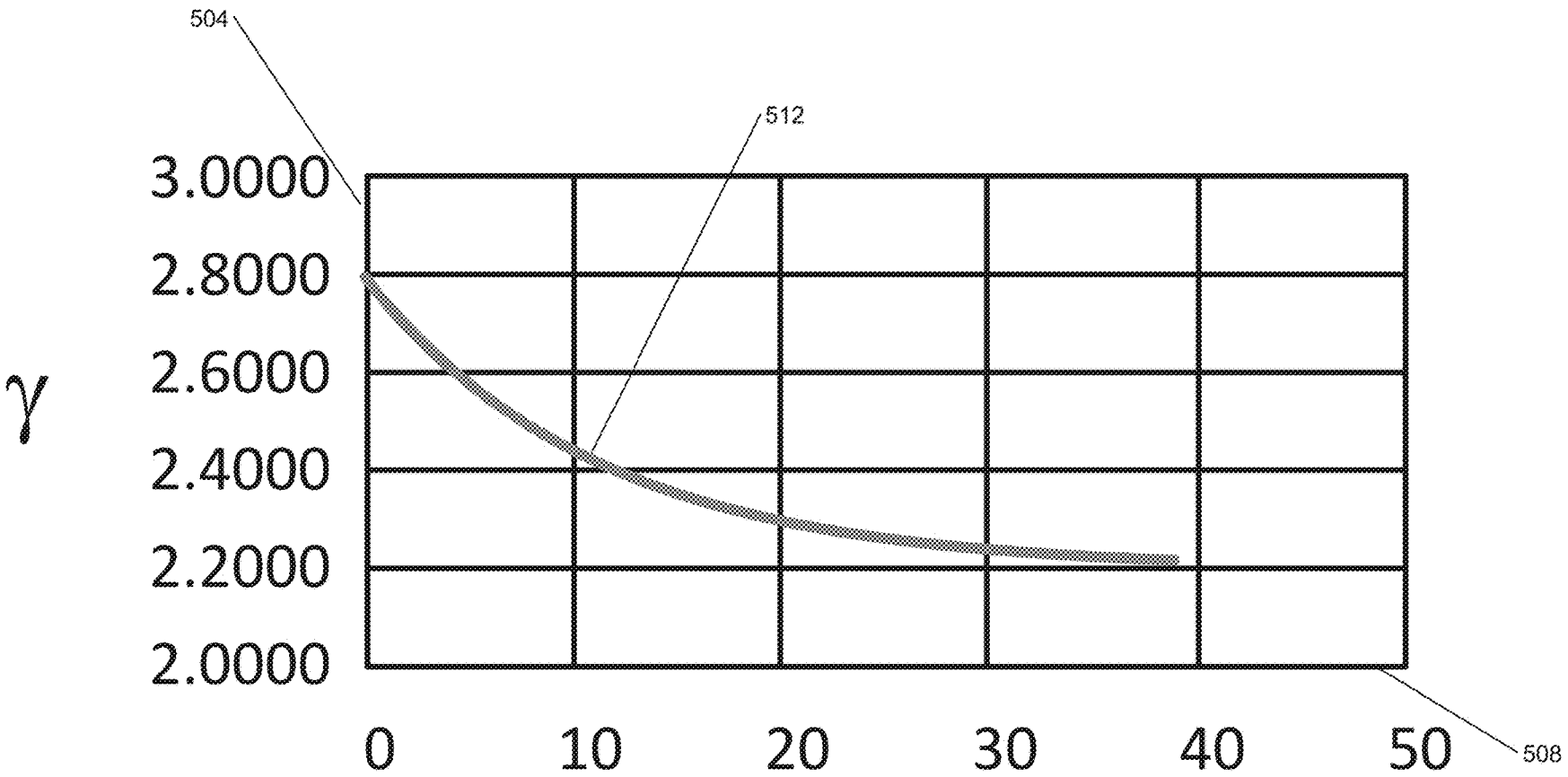
FIG. 5 includes an example graph of gamma versus grayscale value.

At 320, the calibration module 204 determines the remaining GS values that are between the control points up to the predetermined GS value (e.g., $GS_{40}$). The calibration module 204 sets the GS values that are less than or equal to the predetermined GS value to achieve a gamma value that decreases from the first predetermined gamma value (e.g., 2.8) at the first GS value (e.g., $GS_0$) to the second predetermined gamma value (e.g., 2.2) at the predetermined GS value (e.g., $GS_{40}$), where a change in the gamma value from one GS to the next (e.g., GS0 to GS1, GS1 to GS2) is less than a predetermined value, such as 10 percent or 8 percent. FIG. 5 includes an example graph of gamma 504 versus GS value 508 illustrative of a variable gamma curve 512 achieved via GS values between the first GS value (e.g., $GS_0$) and the predetermined GS value (e.g., $GS_{40}$). FIG. 6 is a portion of an example table of GS values 604 and example gamma values 608 corresponding to the example of FIG. 5.

At 324, the calibration module 204 sets the remaining control points for the lookup table 124 to calibrate gamma to the second predetermined value (e.g., 2.2) for all of the GS values from the predetermined GS value (e.g., $GS_{40}$) until the last GS value (e.g., $GS_{255}$). At 328, the calibration module 204 repeats 304-324 for each of the predetermined brightnesses. At 332, the calibration module 204 stores the control points (or all of the GS values determined at 320 and 324) in the lookup table 124 in memory of the calibration computer 208. The lookup table 124 can then be stored in memory of vehicles, such as the vehicle 100, for controlling the display 112.

Figure 4:
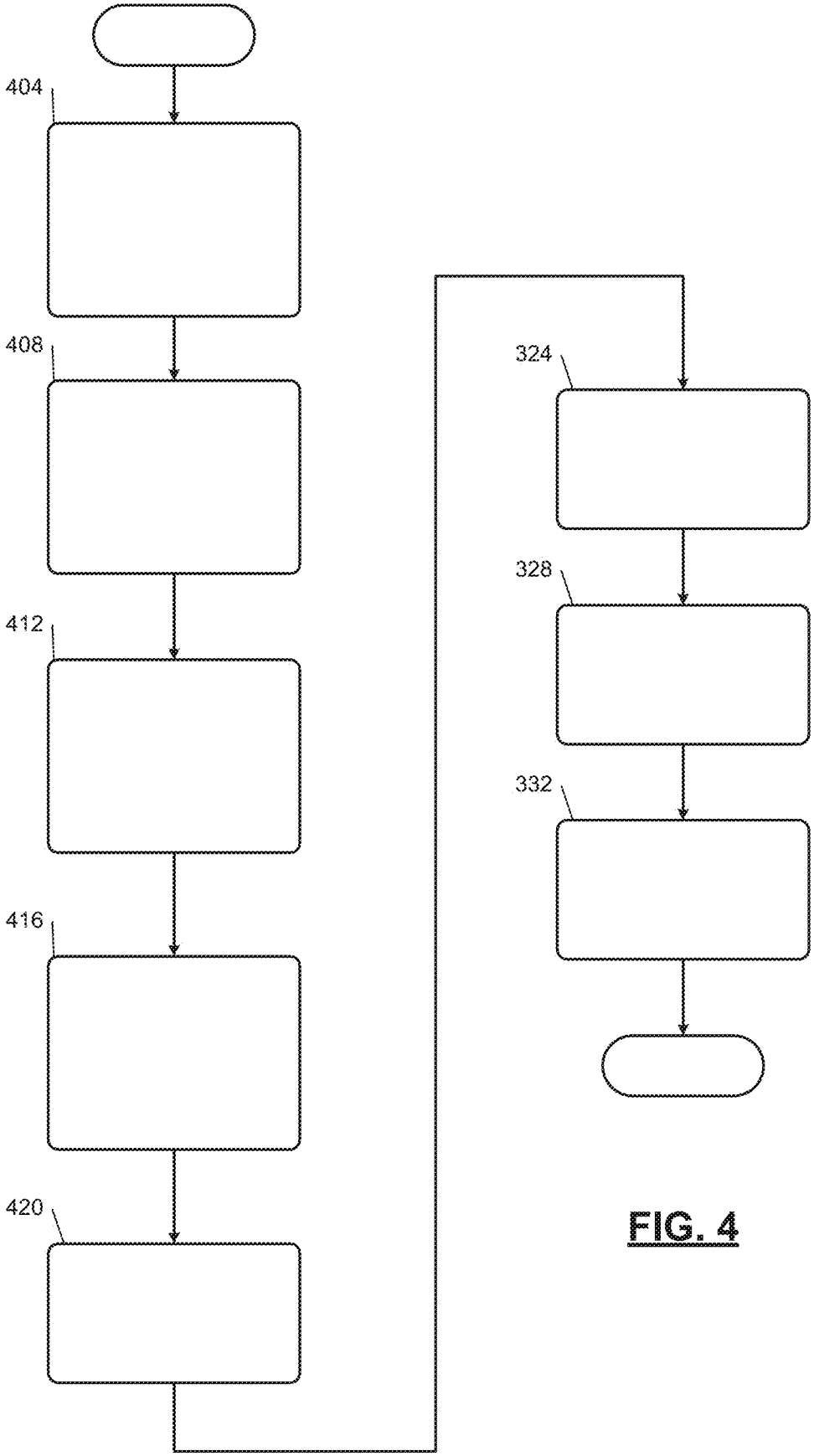

FIG. 4 is a flowchart depicting an example method of calibrating the lookup table 124 with a complete set of measurements. Control begins with 404 where the calibration module 204 determines the first predetermined gamma value such that the transition from the first GS value ($GS_0$) to the second GS value ($GS_1$) is not noticeable by the human eye. Alternatively, the first predetermined gamma value may be determined experimentally and input to the calibration module 204.

At 408, the calibration module 204 models a variable gamma-GS function that decays from the first predetermined gamma value (e.g., 2.8) to the second predetermined gamma value (e.g., 2.2) as the GS values transition from the first GS value (GS0) to the predetermined GS value (e.g., $GS_{39}$). An example gamma-GS function is illustrated in the example of FIG. 5. The gamma-GS function may be, for example, exponential, natural log (ln), power 10 log, or another suitable decaying function. The rate of the decay between the first predetermined gamma value and the second predetermined gamma value may be selected to not allow perceptually noticeable luminance changes between each two adjacent GS values. For example, in the example above, an exponential decay from 2.8 at GS0 to 2.2 at GS40 may have a rate constant set to not allow (i.e., prevent) perceptually noticeable luminance changes (e.g., by less than a predetermined percent) between each two adjacent GS values.

At 412, the calibration module 204 calculates the gamma changes for each GS transition in GS up to the predetermined GS value (e.g., $GS_{39}$). For example, the calibration module 204 determines the gamma change from $GS_0$ to $GS_1$, the gamma change from $GS_1$ to $GS_2$, etc. The calibration module 204 calculates the gamma changes using the gamma-GS function.

At 416, the calibration module 204 calculates each log an corresponding to each gammas by solving the following equation for an:

$$L_{255}=Y_n \log(255)+\log(a_n),$$

where L255 is the luminance at the last grayscale value ($GS_{255}$) and $\gamma_n$ is the gamma value. The calibration module 204 then calculates Ln over the range of possible GS values using the equation:

$$L_n=\gamma_n \log(GS_n)+\log(a_n),$$

where Ln is the luminance of grayscale value n (GSA), an is the predetermined constant value for the grayscale value n, and $\gamma_n$ is the gamma value for the grayscale value n.

At 420, the calibration module 204 set the control points for the lookup table 124 using measured values of luminance at locations (x,y) of pixels to obtain targeted luminance values at locations of pixels, respectively. The targeted luminance values may be predetermined values stored in memory of the calibration computer 208. Control then proceeds with 324-332 as described above.

Figure 7:
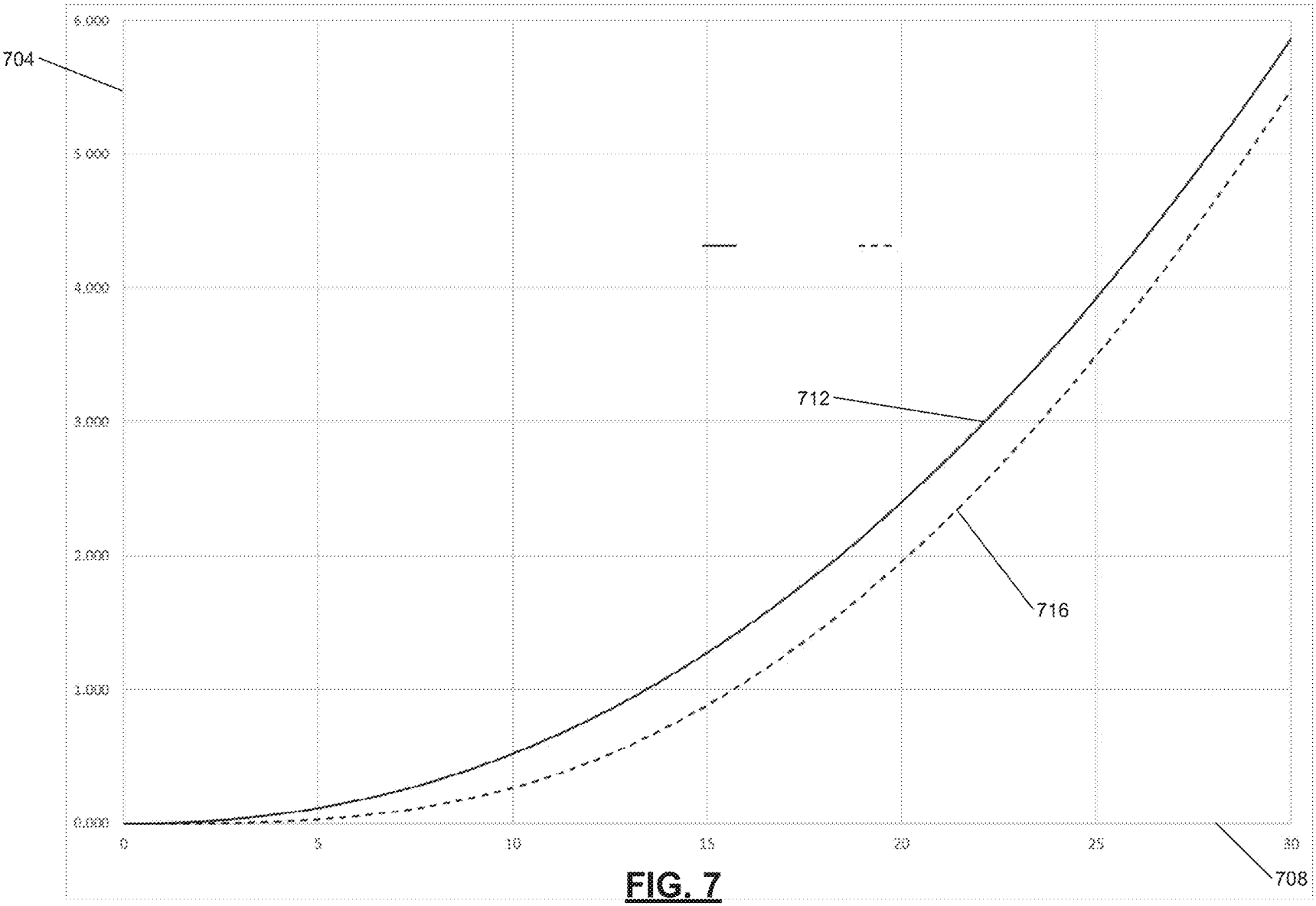
FIG. 7 includes an example graph of luminosity versus grayscale value for different grayscale to gamma curves.

FIG. 7 is an example graph of luminance 704 versus GS values 708. First luminance curve 712 is produced by the display 112 using a lookup table calibrated to achieve a constant gamma of 2.2 and produces banding on the display 112. Second luminance curve 716 is produced by the display 112 using the lookup table 124 calibrated to achieve decreasing gamma at low GS values (up to the predetermined GS value) and the second predetermined gamma (e.g., 2.2) at GS values greater than the predetermined GS value. Second luminance curve 716 does not produce banding as changes in luminance from one GS value to the next GS value are less than that perceptible by the human eye.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

What is claimed is:

1. A display control system comprising:

a display including a plurality of pixels;

a lookup table including grayscale values and magnitudes of power corresponding to the grayscale values, respectively, wherein first ones of the grayscale values that are less than a predetermined grayscale value are calibrated based on the display achieving a gamma of greater than 2.2 and second ones of the grayscale values that are greater than the predetermined grayscale value are calibrated based on the display achieving a gamma of 2.2;

a driver module configured to:

based on a grayscale pixel map including a grayscale value for each pixel of the display, determine magnitudes of power to apply to the pixels, respectively, using the lookup table; and apply power to the pixels of the display according to the determined magnitudes of power, respectively.

2. The display control system of claim 1 further comprising a battery of a vehicle, wherein the driver module is configured to apply power to the pixels of the display from the battery.

3. The display control system of claim 1 further comprising:

an image source configured to generate an image for display on the display; and a grayscale module configured to generate the grayscale pixel map based on the image.

4. The display control system of claim 3 wherein the image source includes a camera of a vehicle.

5. The display control system of claim 3 wherein the image is not gamma corrected.

6. The display control system of claim 1 wherein the display is an organic light emitting diode (OLED) display.

7. The display control system of claim 1 wherein the display is a micro light emitting diode (LED) display.

8. The display control system of claim 1 wherein the first ones of the grayscale values of the lookup table decrease from achieving a first predetermined gamma value that is greater than 2.2 decrease toward achieving a gamma of 2.2 as the first ones of the grayscale values approach the predetermined grayscale value.

9. The display control system of claim 8 wherein the first predetermined gamma value is greater than or equal to 2.5.

10. The display control system of claim 8 wherein the first predetermined gamma value is greater than or equal to 2.7.

11. The display control system of claim 8 wherein the first predetermined gamma value is approximately equal to 2.8.

12. The display control system of claim 8 wherein the lookup table is calibrated such that the decrease from achieving the first predetermined gamma value that is greater than 2.2 to the gamma of 2.2 occurs such that each change in luminance between two adjacent ones of the first ones of the grayscale values is less than a predetermined luminance change.

13. The display control system of claim 8 wherein the lookup table is calibrated such that the decrease from achieving the first predetermined gamma value that is greater than 2.2 to the gamma of 2.2 follows an exponential decay function.

14. The display control system of claim 8 wherein the lookup table is calibrated such that the decrease from achieving the first predetermined gamma value that is greater than 2.2 to the gamma of 2.2 follows a natural log decay function.

15. The display control system of claim 8 wherein the lookup table is calibrated such that the decrease from achieving the first predetermined gamma value that is greater than 2.2 to the gamma of 2.2 follows a power 10 log decay function.

16. The display control system of claim 1 wherein:

the display is configured to achieve 256 different grayscale values; and the lookup table includes less than 256 grayscale values.

17. A display control method, comprising:

based on a grayscale pixel map including a grayscale value for each pixel of a display, determining magnitudes of power to apply to the pixels, respectively, using a lookup table, wherein the lookup table includes grayscale values and magnitudes of power corresponding to the grayscale values, respectively, wherein first ones of the grayscale values that are less than a predetermined grayscale value are calibrated based on the display achieving a gamma of greater than 2.2 and second ones of the grayscale values that are greater than the predetermined grayscale value are calibrated based on the display achieving a gamma of 2.2; and applying power to the pixels of the display according to the determined magnitudes of power, respectively.

18. The display control method of claim 17 wherein applying power to the pixels of the display includes applying power to the pixels of the display from a battery of a vehicle.

19. The display control method of claim 17 further comprising:

generating an image for display on the display; and generating the grayscale pixel map based on the image.

20. The display control method of claim 17 wherein the lookup table is calibrated such that the decrease from achieving the gamma of greater than 2.2 to the gamma of 2.2 occurs such that each change in luminance between two adjacent ones of the first ones of the grayscale values is less than a predetermined luminance change.

* * * * *